US009383708B1

(12) United States Patent
Imaizumi

(10) Patent No.: US 9,383,708 B1
(45) Date of Patent: Jul. 5, 2016

(54) IMAGE FORMING APPARATUS PROVIDING CONTINUED PROCESSING IN THE EVENT OF SENSOR FAILURE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Ryuta Imaizumi, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/692,942

(22) Filed: Apr. 22, 2015

(51) Int. Cl.

| | |
|---|---|
| ***B41J 29/38*** | (2006.01) |
| ***G03G 15/00*** | (2006.01) |
| ***B65H 43/00*** | (2006.01) |
| ***B41J 11/00*** | (2006.01) |

(52) U.S. Cl.
CPC ..... *G03G 15/70* (2013.01); *B41J 11/0095* (2013.01); *B41J 29/38* (2013.01); *B65H 43/00* (2013.01); *B65H 2511/528* (2013.01); *G03G 2215/00548* (2013.01)

(58) Field of Classification Search
CPC ..... B65H 43/08; B65H 2511/528; B65H 2553/41; B65H 2553/412; B65H 2553/414
See application file for complete search history.

(56) References Cited

U.S. PATENT DOCUMENTS 5,034,771 A * 7/1991 Makita ..... G03G 15/234 271/3.17
6,918,587 B2 * 7/2005 Duncan et al. ..... G07D 11/0066 271/258.01

FOREIGN PATENT DOCUMENTS

| | | | |
|---|---|---|---|
| JP | 63060839 | A * | 3/1988 |
| JP | 07187446 | A * | 7/1995 |
| JP | 10139214 | A * | 5/1998 |
| JP | 2001240272 | A * | 9/2001 |
| JP | 2005-263375 | | 9/2005 |
| JP | 2006153912 | A * | 6/2006 |
| JP | 2012071916 | A * | 4/2012 |

* cited by examiner

*Primary Examiner* — Daniel J Colilla
(74) *Attorney, Agent, or Firm* — Amin, Turocy & Watson LLP

(57) ABSTRACT

An image forming apparatus comprises a conveyance section, a plurality of sensors, an image forming section, a conveyance control section and a control section. The conveyance section forms a conveyance path for conveying paper. The plurality of sensors outputs detection signals indicating the existence of the paper at a plurality of positions along the conveyance path. The image forming section forms images on the paper conveyed by the conveyance section. The conveyance control section controls the conveyance of the paper conveyed by the conveyance section based on the detection signals of the plurality of sensors. The control section determines, in a case in which the detection signal of any of the plurality of sensors is abnormal, whether it is due to sensor failure or paper conveyance abnormality, and sets to ignore the detection signal of the failed sensor and continue the processing if it is due to the sensor failure.

6 Claims, 3 Drawing Sheets

IMAGE FORMING APPARATUS PROVIDING CONTINUED PROCESSING IN THE EVENT OF SENSOR FAILURE

FIELD

Embodiments described herein relate generally to an image forming apparatus and a control method of the image forming apparatus.

BACKGROUND

Conventionally, an image forming apparatus cannot be used if a sensor for detecting printing paper is out of order and the paper being conveyed cannot be detected normally. The image forming apparatus of which the sensor is out of order cannot be used until the sensor out of order is repaired or exchanged. Generally, the job of repairing or exchanging the sensor is carried out by a service man armed with professional knowledge. That is, if the sensor is out of order, there is a problem that the conventional image forming apparatus cannot be used until the sensor out of order is repaired or exchanged by a service man.

DETAILED DESCRIPTION

In accordance with one embodiment, an image forming apparatus comprises a conveyance section, a plurality of sensors, an image forming section, a conveyance control section and a control section. The conveyance section forms a conveyance path for conveying paper. The plurality of sensors outputs detection signals indicating the existence of the paper at a plurality of positions along the conveyance path. The image forming section forms an image on the paper conveyed by the conveyance section. The conveyance control section controls the conveyance of the paper conveyed by the conveyance section based on the detection signals of the plurality of sensors. The control section determines, in a case in which the detection signal of any of the plurality of sensors is abnormal, whether it is due to sensor failure or paper conveyance abnormality, and sets to ignore the detection signal of the failed sensor and continue the processing if it is due to the sensor failure.

Hereinafter, the embodiment is described in detail with reference to the accompanying drawings.

Figure 1:
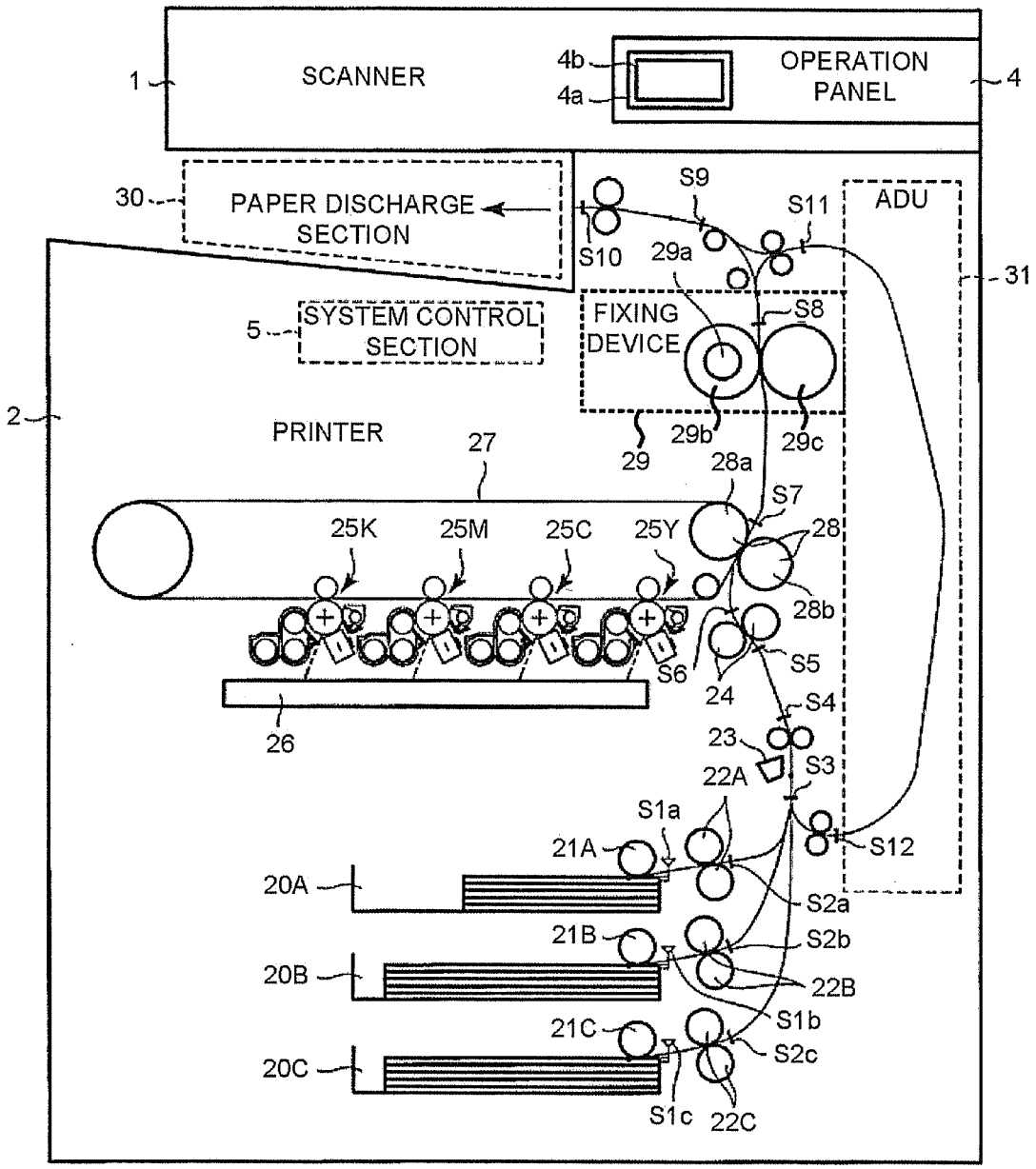
FIG. 1 is a cross-sectional view schematically illustrating an example of the constitution of a digital multi-functional peripheral according to an embodiment.

FIG. 1 is a cross-sectional view schematically illustrating an example of the constitution of a digital multi-functional peripheral according to the embodiment. The digital multi-functional peripheral (MFP) according to the present embodiment is an apparatus including an image forming apparatus. In the example shown in FIG. 1, the digital multi-functional peripheral includes a scanner 1, a printer 2, an operation panel 4 and a system control section 5.

The scanner 1 reads an image of a document and converts the read image into image data. The scanner 1 includes, for example, a COD line sensor for converting the image on the reading surface of the document into image data. The scanner 1 may be a device for scanning the document placed on the document table glass or a device for reading the image of the document conveyed by an ADF (Auto Document Feeder). The scanner 1 has a function (document detecting function) of detecting the size of the document. The scanner 1 is arranged at, for example, the upper portion of a main body of the digital multi-functional peripheral. The scanner 1 is controlled by the system control section 5. The scanner 1 outputs the image data of the document to the system control section 5.

The printer 2 forms an image on the paper serving as an image receiving medium. The printer 2 serving as the image forming apparatus has a color printing function for printing a color image on the paper and a monochrome printing function for printing monochrome (for example, black) image on the paper. For example, the printer 2 is an electrophotographic type image forming apparatus. The printer 2 forms the color image with toner of a plurality of colors (for example, yellow (Y), cyan (C) and magenta (M)). The printer 2 forms the monochrome image with monochrome (for example, black) toner. The printer 2 is not limited to the electrophotographic type image forming apparatus as long as it has the color printing function and the monochrome printing function. For example, the printer 2 may be an inkjet type image forming apparatus or a thermal transfer type image forming apparatus.

In the example of constitution shown in FIG. 1, the printer 2 includes a paper feed cassette 20 (20A, 20B and 20C). The paper feed cassette 20 is a paper feed section for supplying the paper to be printed with image. The printer 2 may further include a manual feeding tray serving as a paper feed section. For example, each paper feed cassette 20A, 20B and 20C is arranged at the lower portion of the main body of the digital multi-functional peripheral in a detachable manner. Each of the paper feed cassettes 20A, 20B and 20C stores the paper of a set category (for example, size and paper quality).

Setting information such as the information relating to the paper stored in each paper feed cassette is stored in a non-volatile memory (for example, the later-described NVM 54) The printer 2 selects, according to the setting information, the paper feed cassette which stores the paper to be used in the printing processing. The printer 2 prints the image on the paper fed from the selected paper feed cassette. In a case in which the printer 2 is provided with a manual feeding tray, similar to each paper feed cassette, the setting information for the manual feeding tray may also be stored in the nonvolatile memory.

Each paper feed cassette 20A, 20B and 20C is provided with pickup rollers 21A, 21B and 21C, respectively. The pickup rollers 21A, 21B and 21C picks up the paper one by one from each paper feed cassette 20A, 20B and 20C. The pickup rollers 21A, 21B and 21C supply the picked up paper to a conveyance path (conveyance section) 22 consisting of a plurality of conveyance rollers.

The conveyance section 22 conveys the paper in the printer 2. For example, the conveyance section 22 conveys the paper picked up by the pickup rollers 21A, 21B and 21C to a register roller 24. The register roller 24 conveys the paper to a transfer position at the timing of transferring the image from an intermediate transfer belt 27 to the paper. The conveyance section 22 conveys the paper passing through the register roller 24 to the transfer position. The conveyance section 22 conveys the paper passing through the transfer position to a fixing device 29 from the transfer position. The conveyance section 22 further conveys the paper passing through the fixing device 29 to either a paper discharge section 30 or an automatic double-sided unit (ADU) 31.

Sensors S1~Sn detect the paper at each position of the conveyance path formed by the conveyance section 22. The sensors S1~Sn output a signal indicating the existence of the paper. An example of the arrangement of the sensors S1~S12 is shown in FIG. 1. For example, in the example shown in FIG. 1, sensors S1*a*, S1*b* and S1*c* detect the paper picked up by the pickup rollers 21A, 21B and 21C, respectively. The sensor S5 detects the paper at a position in front of the later-described register roller 24. The sensor S10 detects the paper to be discharged from the printer 2 to the paper discharge section 30. In addition, the arrangement of each of the sensors S1~Sn is not limited to the example shown in FIG. 1. No specific limitation is given to the arrangement of each of the sensors S1~Sn as long as the sensors S1~Sn detect the paper at each position of the conveyance path.

An image forming section 25 (25Y, 25M, 25C and 25K), an exposure section 26, the intermediate transfer belt 27 and a transfer section 28 function as image forming modules for forming an image. The image forming section 25 (25Y, 25M, 25C and 25K) forms an image to be transferred to the paper. In the example of constitution shown in FIG. 1, the image forming section 25Y forms an image with yellow toner. The image forming section 25M forms an image with magenta toner. The image forming section 25C forms an image with cyan toner. The image forming section 25K forms an image with black toner.

The exposure section 26 forms an electrostatic latent image on a photoconductive drum (image carrier) of each image forming section 25 (25Y, 25M, 25C and 25K) with laser light. The exposure section 26 emits the laser light controlled according to the image data to the photoconductive drum through an optical system such as a polygon mirror and the like. The laser light from the exposure section 26 forms the electrostatic latent image on the surface of each photoconductive drum. The exposure section 26 controls the laser light according to the control signal from the system control section 5.

Each image forming section 25 (25Y, 25M, 25C and 25K) develops the electrostatic latent image formed on the photoconductive drum thereof with the toner of each color to form a toner image serving as a visible image on the photoconductive drum. The intermediate transfer belt 27 serves as an intermediate transfer body. Each image forming section 25 (25Y, 25M, 25C and 25K) transfers (primarily transfers) the toner image formed on the photoconductive drum to the intermediate transfer belt 27. Each image forming section 25 (25Y, 25M, 25C and 25K) applies a transfer bias voltage to the toner image at the primary transfer position. Each image forming section 25 (25Y, 25M, 25C and 25K) controls the transfer bias voltage through transfer current. The toner image on each photoconductive drum is transferred to the intermediate transfer belt 27 by the transfer bias voltage at the primary transfer position of the each photoconductive drum. The system control section 5 controls the transfer current used by each image forming section in the primary transfer processing.

For example, in a case of forming a monochrome image, the image forming section 25K transfers (primarily transfers) the toner image (visible image) developed with black (monochrome) toner to the intermediate transfer belt 27. As a result, the intermediate transfer belt 27 holds the monochrome image formed with the black (monochrome) toner.

Further, in a case of forming a color image, each image forming section 25Y, 25M, 25C and 25K transfers (primarily transfers) the toner image (visible image) developed with the toner of each color (yellow, magenta, cyan and black) to the intermediate transfer belt 27 in an overlapped manner. As a result, the intermediate transfer belt 27 holds the color image obtained by overlapping the toner image of each color.

The transfer section 28 transfers the toner image on the intermediate transfer belt 27 to the paper at a secondary transfer position. The secondary transfer position refers to a position where the toner image on the intermediate transfer belt 27 is transferred to the paper. The secondary transfer position is a position where a support roller 28*a* and a secondary transfer roller 28*b* are opposite to each other. The transfer section 28 applies a transfer bias voltage controlled through the transfer current at the secondary transfer position. The transfer section 28 transfers the toner image (decolorable toner image or normal toner image) on the intermediate transfer belt 27 to the paper through the transfer bias voltage. The system control section 5 controls the transfer current used in the secondary transfer processing.

The fixing device 29 has a function of fixing the toner on the paper. For example, in the embodiment, the fixing device 29 applies heat to the paper to fix the toner image on the paper. However, the fixing device 29 is not limited to this; the fixing device 29 may use other method as long as it can fix the image on the paper.

The fixing device 29 applies heat to the paper to carry out fixing processing. In the example shown in FIG. 1, the fixing device 29 includes a heating roller 29*b* inside which a heating section 29*a* is arranged and a pressing roller 29*c* brought into pressure contact with a fixing belt heated by the heating roller 29*b*. The heating section 29*a* is a heater capable of controlling temperature. For example, the heating section 29*a* may be a heater lamp such as a halogen lamp and the like or an induction heating (IH) type heater. Further, the heating section 29*a* may include a plurality of heaters.

For example, in a case of carrying out the fixing processing to fix the toner image on the paper, the system control section 5 controls the fixing device 29 to a fixing temperature. The fixing device 29 controlled to the fixing temperature presses the paper to which the toner image is transferred by the transfer section 28 and meanwhile heats the paper at the fixing temperature. In this way, the fixing device 29 fixes the toner image on the paper. Then the fixing device 29 conveys the paper subjected to the fixing processing to either the paper discharge section 30 or the ADU 31.

In a case of discharging the paper subjected to the fixing processing by the fixing device 29, the paper is conveyed to the paper discharge section 30. In a case of forming an image on the back side of the paper subjected to the fixing processing by the fixing device 29, the paper is temporarily conveyed to the side of the paper discharge section 30 and then switched back and conveyed towards the ADU 31. In this case, the ADU 31 supplies the paper reversed through the switchback to the front side of the register roller 24 again.

The operation panel 4 serving as a user interface is provided with a display section 4*a* including a touch panel 4*b* and various buttons. The system control section 5 controls the content to be displayed on the display section 4*a* of the operation panel 4. The operation panel 4 outputs the information input through the touch panel 4*b* or the buttons of the display section 4*a* to the system control section 5. A user designates an operation mode or inputs the information such as the setting information and the like on the operation panel 4.

Next, the constitution of a control system of the digital multi-functional peripheral is described.

Figure 2:
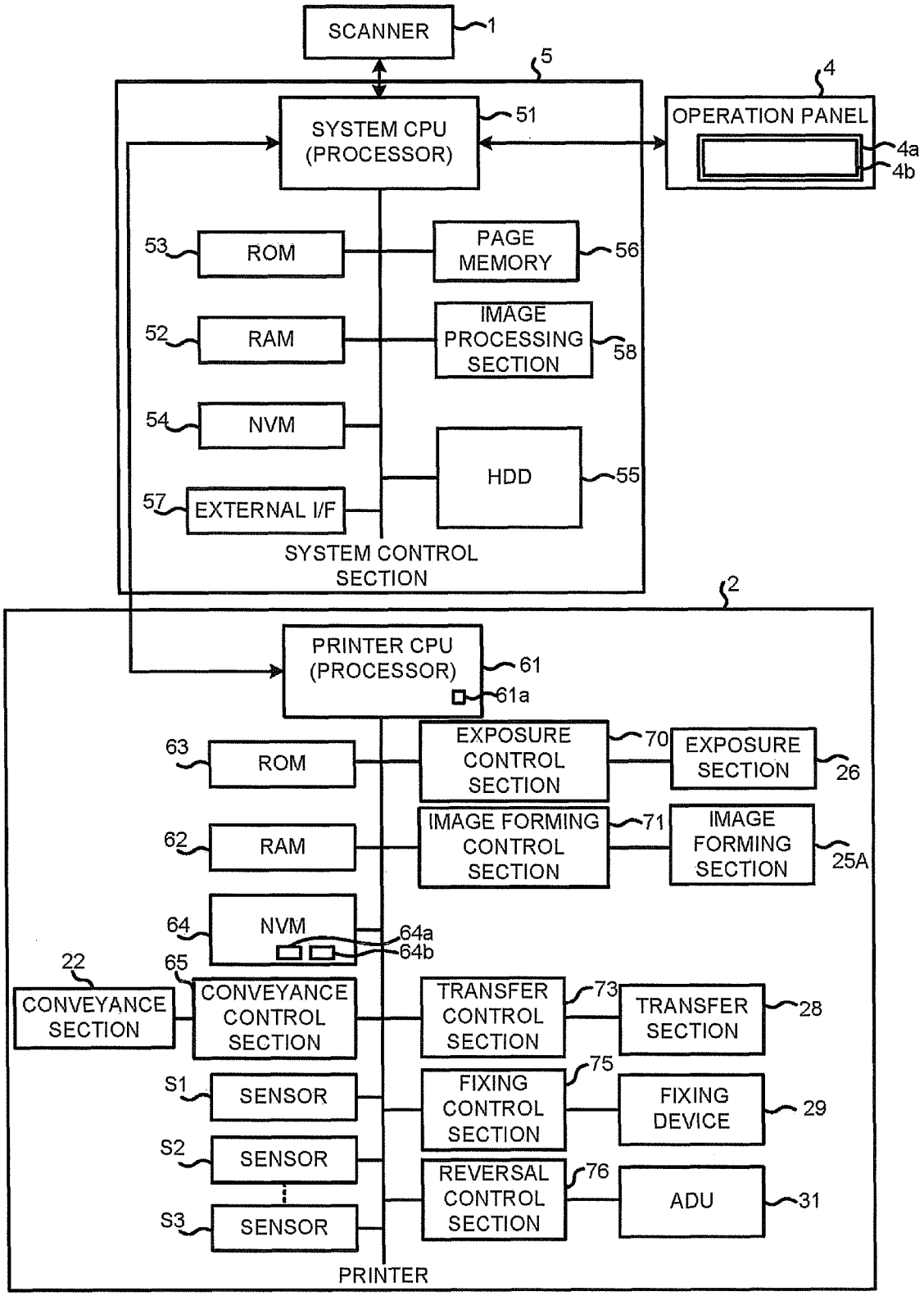
FIG. 2 is a block diagram illustrating an example of the constitution of a control systems in the digital multi-functional peripheral according to the embodiment.

FIG. 2 is a block diagram schematically illustrating an example of the constitution of the control systems in the system control section 5 and the printer 2 of the digital multi-functional peripheral.

In the example of constitution shown in FIG. 2, the system control section 5 includes a system CPU (processor) 51, a RAM 52, a ROM 53, the nonvolatile memory (NVM) 54, a HDD 55, a page memory 56, an external interface (I/F) 57 and an image processing section 58.

The system CPU 51 uniformly controls the whole digital multi-functional peripheral and each section. The system CPU 51 is a processor which executes programs to realize processing. The system CPU 51 is connected with each section in the system control section 5 through a system bus. The system CPU 51 is further connected with the scanner 1, the printer 2, the operation panel 4 and the like through the system bus in addition to each section in the system control section 5. The system CPU 51 outputs an operation instruction to each section and acquires various kinds of information from each section through bidirectional communication with the scanner 1, the printer 2 and the operation panel 4. The system CPU 51 inputs information indicating the operation state and a detection signal of various sensors arranged in each section in the system control section 5.

The RAM 52, which is a volatile memory, functions as a working memory or a buffer memory. The ROM 53 is an unrewritable nonvolatile memory for storing programs, control data and the like. The system CPU 51 uses the RAM 52 and executes the programs stored in the ROM 53 (or the nonvolatile memory 54, the HDD 55) to realize various processing. For example, the system CPU 51 executes the programs to function as a printing execution module and a printing-forbidding module.

The nonvolatile memory (NVM) 54 is a rewritable nonvolatile memory. The NVM 54 stores the control data and the control programs executed by the system CPU 51. The NVM 54 further stores various kinds of setting information, processing conditions and the like. For example, the NVM 54 stores the setting information for each paper feed cassette (paper feed section).

The hard disk drive (HDD) 55, which is a high-capacity storage device, stores the image data, various kinds of operation history information and the like. Further, the HDD 55 may store the control program and the control data, or the setting information and the processing conditions and the like.

The page memory 56 is used for copying or decompressing the image data to be processed. For example, in a case of carrying out copying processing, the page memory 56 stores the image data read by the scanner 1 and subjected to the image processing for scanning. The system CPU 51 carries out the image processing for printing on the image data stored in the page memory 56 and then outputs the processed data to the printer 2. The system CPU 51 may store the image data stored in the page memory 56 in the HDD 55 or send the image data to an external device through the external interface 57.

The external interface (I/F) 57 is used for communicating with the external device. For example, the external interface 57 receives the printing data corresponding to a print request from the external device. The external interface 57 may be any interface that carries out data notification with the external device; for example, the external interface 57 may be an interface locally connected with the external device or a network interface for communicating through the network.

The image processing section 58 includes functions of an image processing section of a scanner system which carries out image processing on the image data read by the scanner 1, a compression and expansion section which carries out the compression or expansion of the image data, and an image processing section of a printer system which generates the image data for printing to be printed on the paper by the printer 2. For example, the function of the image processing section of the scanner system includes a shading correction processing, a gradation conversion processing, an interline correction processing and the like.

Next, an example of the constitution of the control system in the printer 2 is described.

In the example of constitution shown in FIG. 2, the printer 2 includes a printer CPU (processor) 61, a RAM 62, a ROM 63, a nonvolatile memory (NVM) 64, a conveyance control section 65, an exposure control section 70, an image forming control section 71, a transfer control section 73, a fixing control section 75, a reversal control section 76 and the like as the constitution of a control system.

The printer CPU 61 is in charge of the control of the whole printer 2. The printer CPU 61 is a processor which executes programs to realize processing. The printer CPU 61 is connected with each section in the printer 2 through a system bus. The printer CPU 61 outputs an operation instruction to each section in the printer 2 according to an operation instruction from the system CPU 51. The printer CPU 61 notifies the system CPU 51 of the information indicating the processing status in the printer 2.

The printer CPU 61 is further connected with each sensor S (S1~Sn) through the system bus. The printer CPU 61 includes a timer 61*a*. The printer CPU 61 controls the conveyance of the paper in the printer 2 according to the detection result of each sensor S and the time (timing) measured by the timer 61*a*. For example, the printer CPU 61 monitors the paper detection carried out by each sensor Sat pre-determined timing. In a case in which each sensor does not output the detection signal indicating the existence of paper at the pre-determined timing, the printer CPU 61 determines that the detection signal of the sensor is abnormal. The printer CPU 61, if determining that the detection signal of the sensor is abnormal, determines whether the sensor detects the paper conveyance abnormality (jam) or the sensor is out of order.

The RAM 62, which is a volatile memory, functions as a working memory or a buffer memory. The ROM 63 is an unrewritable nonvolatile memory for storing programs, control data and the like. The printer CPU 61 uses the RAM 62 and executes the programs stored in the ROM 63 (or the nonvolatile memory 64) to realize various processing.

The nonvolatile memory (NVM) 64 is a rewritable nonvolatile memory. For example, the nonvolatile memory 64 stores the control data and the control programs executed by the printer CPU 61. The nonvolatile memory 64 further stores setting information, processing conditions and the like. For example, the nonvolatile memory 64 stores information indicating a first condition and a second condition used in the later-described determination (determination on jam or sensor failure).

The nonvolatile memory 64 includes a table for storing information indicating the usage status (operation status) of the whole printer 2 or each sensor S. For example, the nonvolatile memory 64 includes a table 64*a* for storing information indicating the usage status (or the service life) of the whole printer 2 such as a total number of printings or a total use time and the like. The nonvolatile memory 64 may further be provided with a table 64*b* for storing information indicating the usage status such as the total number of printings or the total use time for each sensor S. The nonvolatile memory 64 may further store the number of abnormality-occurrence times of the detection signal of each sensor S.

The conveyance control section 65 controls the conveyance of paper in the printer 2. The conveyance control section 65 controls the driving of the pickup roller 21 and the conveyance section 22. The conveyance control section 65 controls the driving of the conveyance roller serving as the conveyance section 22 in the printer 2 according to the operation instruction from the printer CPU 61. For example, the printer CPU 61 instructs the conveyance control section 65 to carry-out the paper conveyance control according to the instruction indicating the start of the image forming processing from the system control section 5.

The exposure control section 70 controls the exposure section 26. The exposure control section 70 controls the exposure section 26 according to the operation instruction from the printer CPU 61 to form the electrostatic latent image on the photoconductive drum of each image forming section 25Y, 25M, 25C and 25K. For example, the exposure control section 70 controls the laser light emitted from the exposure section 26 to each photoconductive drum according to the image data instructed by the printer CPU 61.

The image forming control section 71 controls the driving of each image forming section 25Y, 25M, 25C and 25K. The image forming control section 71 controls to develop the electrostatic latent image formed on the photoconductive drum of each image forming section 25Y, 25M, 25C and 25K with the toner of each color according to the operation instruction from the printer CPU 61. The transfer control section 73 controls the driving of the transfer section 28, the transfer current and the like. The transfer control section 73 controls to transfer the toner image transferred to the intermediate transfer belt 27 to the paper by the transfer section 28 according to the operation instruction from the printer CPU 61.

The fixing control section 75 controls the driving of the fixing device 29. The fixing control section 75 controls to drive the heating roller 29*b* and the pressing roller 29*c* according to the operation instruction from the printer CPU 61. The fixing control section 75 controls the heating section 29*a* to control the surface temperature of the heating roller 29*b* to a desired temperature. The fixing control section 75 controls the surface temperature of the heating roller 29*b* to a temperature (fixing temperature) designated by the printer CPU 61.

The reversal control section 76 controls the driving of the ADU 31. The reversal control section 76 controls the ADU 31 to supply the paper passing through the fixing device 29 to the image reading position of the scanner 23 again according to the operation instruction from the printer CPU 61. For example, in a case of forming an image on the back side of the paper subjected to the fixing processing (in a case of carrying out duplex printing), the reversal control section 76 conveys the paper subjected to the fixing processing towards the side of the paper discharge section 30 temporarily, and then switches the paper back and conveys the paper to the ADU 31. The ADU 31 supplies the paper switched back from the side of the paper discharge section 30 to a position in front of the register roller 24 again.

Next, the operation of the printer 2 of the digital multi-functional peripheral according to the embodiment is described.

Figure 3:
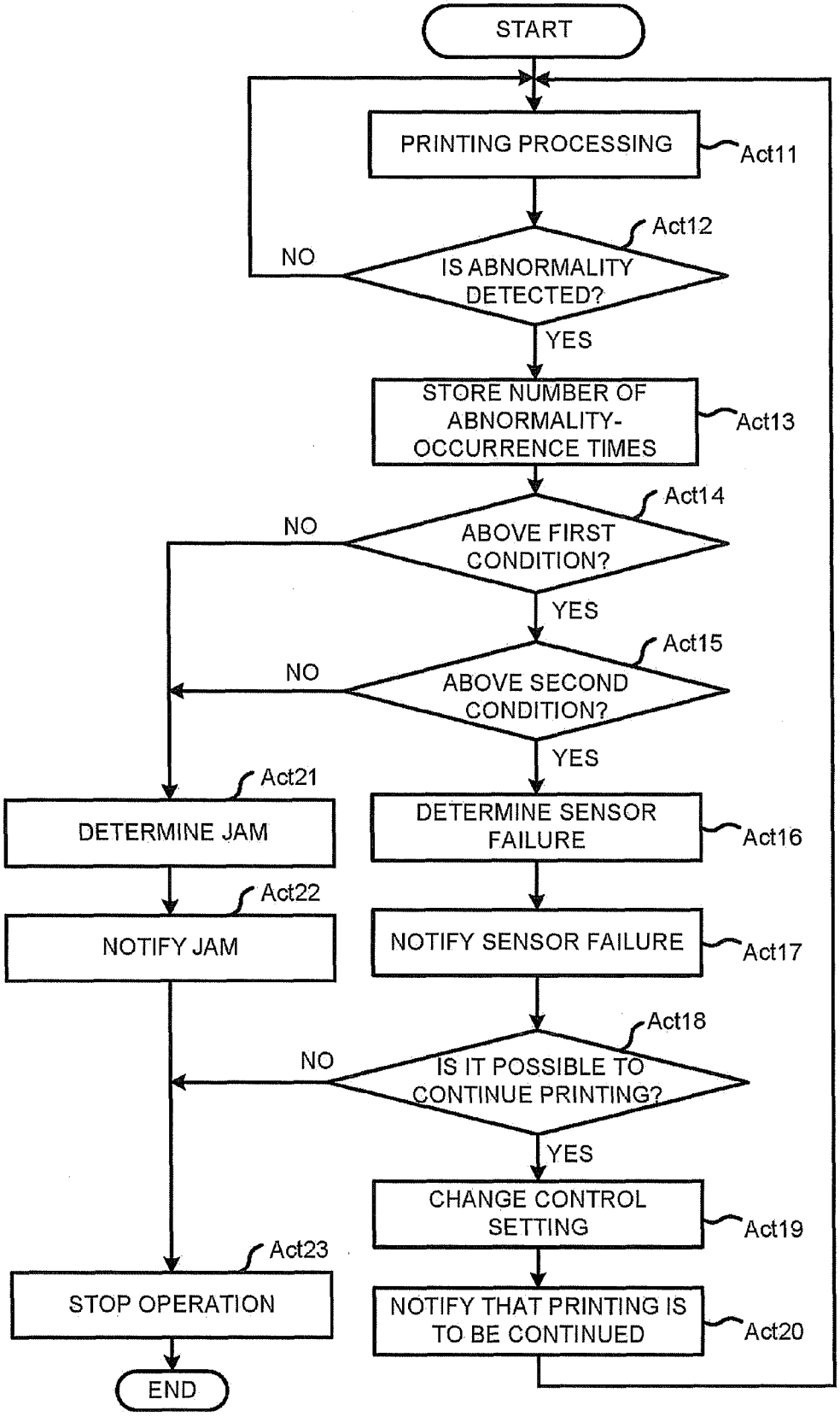
FIG. 3 is a flowchart illustrating an example of the operation of the digital multi-functional peripheral according to the embodiment.

FIG. 3 is a flowchart illustrating the processing carried out in a case in which the detection signal abnormality of the sensor S is detected in the printer 2.

In the printer 2, the printer CPU 61 executes the printing processing according to the instruction from the system CPU 51 (ACT 11). In the printing processing, the printer CPU 61 controls the conveyance of paper in the printer 2 as well as the image forming operation.

During the printing processing, the printer CPU 61 monitors the conveyance state of paper based on the detection signal of each sensor S and the timing counted by the timer 61*a* (ACT 12). That is, the printer CPU 61 checks whether or not each sensor S detects the paper at the desired timing along the conveyance route from the paper feed to the paper discharge. For example, the printer CPU 61 predicts the timing at which the paper is supposed to be detected by each sensor S arranged along the conveyance route according to the conveyance speed of paper and the like. The printer CPU 61 confirms (monitors) that each sensor S actually detects the paper at the predicted timing. In a case in which some sensor cannot detect the paper at the desired timing, the printer CPU 61 determines that the detection signal of the sensor is abnormal. The abnormality of the detection signal of the sensor indicates that the paper conveyance abnormality occurs at a position in front of the sensor or that the sensor is out of order.

There may be a failure that the sensor keeps outputting the detection signal indicating the existence of paper. The sensor in which such failure occurs keeps outputting the detection signal indicating the existence of paper even at the timing when the paper does not exist, and thus can detect it as the abnormality of the detection signal.

If it is detected that the detection signal of the sensor is abnormal (abnormality occurrence), the printer CPU 61 determines whether the paper conveyance abnormality (jam) occurs or the sensor is out of order (ACT 14 and ACT 15).

That is, the printer CPU 61, if detecting that the detection signal of the sensor is abnormal, stores, in association with the sensor, the number of times (the number of abnormality-occurrence times) the abnormality of detection signal is detected (ACT 13). For example, the printer CPU 61 stores the number of abnormality-occurrence times in the NVM 64. However, the number of abnormality-occurrence times may be stored for each sensor in the RAM 63 as long as the number of abnormality-occurrence times is counted up since the power of the digital multi-functional peripheral is turned on.

After storing the number of abnormality-occurrence times in association with the sensor, the printer CPU 61 determines whether or not the number of abnormality-occurrence times of the sensor is above the first condition (ACT 14). The first condition is a first determination criterion for determining whether or not the sensor of which the detection signal is abnormal is out of order. The sensor out of order cannot detect the paper, thus, it outputs an abnormal detection signal every time the paper is conveyed. Thus, a reference value for the number of abnormality-occurrence times of each sensor may be set as the first condition. For example, in a case in which the first condition is set to 10 times, the printer CPU 61 determines whether or not the number of abnormality-occurrence times of each sensor is above 10 times.

The printer CPU 61, if determining that the number of abnormality-occurrence times is above the first condition (YES in ACT 14), determines whether or not the usage status of the printer 2 is above the second condition (ACT 15). The second condition is a second determination criterion for determining whether or not the sensor of which the detection signal is abnormal is out of order. It is considered that the higher the usage frequency of the sensor S is, the more easily the sensor failure occurs. Thus, a reference value for the usage status (a value indicating the service life) of the printer 2 or each sensor S may be set as the second condition. For example, a reference value for the value indicating the service life such as the total number of printings of the whole printer 2 may be set as the second condition. A reference value for the total number of printings which is recorded for each sensor as the value indicating the service life of each sensor may be set as the second condition. Alternatively, a reference value for the operation time and the like for the whole printer 2 or each sensor may be set as the second condition.

The printer CPU 61, if determining that the usage status of the printer 2 is above the second condition (YES in ACT 15), determines that the sensor of which the detection signal is abnormal is out of order (ACT 16). If it is determined that the sensor is out of order, the printer CPU 61 displays guidance of a service man call or displays that the sensor is out of order on the display section 4*a* (ACT 17).

In addition, the printer CPU 61 may omit the determination in ACT 15 described above. That is, the printer CPU 61 may determine that the sensor of which the detection signal is abnormal is out of order in a case in which the number of abnormality-occurrence times is above the first condition (YES in ACT 14).

After determining that the sensor is out of order, the printer CPU 61 determines whether or not it is possible to ignore the detection result of the sensor determined to be out of order and continue the printing processing (paper conveyance) (ACT 18). For example, the NVM 63 stores information indicating a specific sensor of which the detection result cannot be ignored to continue the printing processing. In this case, the printer CPU 61 determines whether or not it is possible to ignore the detection result of the sensor determined to be out of order and continue the printing processing based on the information stored in the NVM 63.

For example, the register roller 24 is used to adjust the timing of transferring the image to the paper. Thus, the sensor S5 arranged at a position in front of the register roller 24 may be set as a specific sensor of which the detection result cannot be ignored to continue the printing processing. Further, the sensor S10 shown in FIG. 1 is used to confirm whether or not the paper is discharged to the outside of the printer 2. Thus, the sensor S10 may be set as a specific sensor of which the detection result cannot be ignored to continue the printing processing. In the constitution shown in FIG. 1, the sensors S1*a*, S1*b* and S1*c* are used to detect the picking up of the paper. Thus, the sensors S1*a*, S1*b* and S1*c* may be set as the specific sensors of which the detection results cannot be ignored to continue the printing processing.

It may be determined that the detection result cannot be ignored to continue the printing processing in a case in which a plurality of specific sensors are out of order. For example, the NVM 63 stores information indicating a combination of a plurality of sensors according to which it is determined that the printing processing cannot be continued. In this case, the printer CPU 61 determines whether or not it is possible to ignore the detection results of the plurality of sensors determined to be out of order and continue the printing processing based on the information stored in the NVM 63.

The printer CPU 61, if determining that the printing processing can be continued (YES in ACT 18), ignores the detection result of the sensor determined to be out of order and changes to the operation setting for executing the printing processing (ACT 19). For example, the printer CPU 61 continues the printing processing by ignoring the detection signal of the sensor determined to be out of order and monitoring the paper conveyance according to the time counted by the timer 61*a*. After it is changed to the operation setting for ignoring the detection result of the sensor determined to be out of order, the printer CPU 61 returns to ACT 11 to continue the printing processing.

In a case of ignoring the sensor determined to be out of order and continuing the printing processing, the printer CPU 61 displays on the display section 4*a* that the sensor is out of order and that the printing processing is to be continued (ACT 20). That is, the printer CPU 61 notifies the user of the occurrence of the sensor failure even in a case of continuing the printing processing. In this way, the printer 2 can notify the user of the occurrence of the sensor failure even in a state in which the printing processing is continued, that is, in a state in which the printer 2 can be used.

If it is determined that the printing processing cannot be continued (NO in ACT 18), the printer CPU 61 stops the operation of the printer 2 (ACT 23).

The printer CPU 61, if determining that the number of abnormality-occurrence times of the sensor is not above the first condition (NO in ACT 14) or determining that the usage status is not above the second condition (NO in ACT 15), determines that the paper conveyance abnormality (jam) occurs (ACT 21). The printer CPU 61, if determining the paper conveyance abnormality, displays on the display section 4*a* of the operation panel 4 that the paper conveyance abnormality (jam) occurs (ACT 22). In this case, the printer CPU 61 may display a guidance such as a jam occurrence position, a jam removing method and the like on the display section 4*a* based on the position of the sensor which detects the abnormality. If the paper conveyance abnormality is determined, the printer CPU 61 stops the operation of the printer 2 with the jam guidance displayed on the display section 4*a* (ACT 23).

If it is determined that the detection result of the sensor determined to be out of order cannot be ignored to continue the printing processing (NO in ACT 18), the printer CPU 61 stops the operation of the printer 2 (ACT 23). In this case, the printer CPU 61 stops the operation of the printer 2 in a state in which the service man call or the sensor failure is displayed. In this way, the user can be aware that the reason why the operation of the printer 2 is stopped is that the sensor is out of order.

As stated above, the image forming apparatus according to the present embodiment controls the conveyance of paper according to the detection signals of a plurality of sensors arranged in the conveyance path and the time counted by the timer. If it is determined that the detection signal of the sensor is abnormal, the image forming apparatus determines whether it is due to the sensor failure or the paper conveyance abnormality according to the number of abnormality-occurrence times of the sensor. If it is due to the sensor failure, the image forming apparatus ignores the detection result of the failed sensor and continues the paper conveyance.

In this way, the image forming apparatus according to the present embodiment can continue executing the image forming processing even if the sensor arranged in the conveyance path is out of order. As a result, even if the sensor is out of order, the image forming apparatus can be still used continuously before being repaired by the service man.

The image forming apparatus according to the present embodiment determines whether or not the sensor is out of order according to the usage status of the whole apparatus or each sensor as well as according to the number of abnormality-occurrence times. In this way, the image forming apparatus according to the present embodiment determines the failure of sensor according to not only the number of abnormality-occurrence times but also the usage status of the apparatus.

Further, the image forming apparatus according to the present embodiment can set the specific sensor that cannot be ignored in the printing processing. If it is determined that the sensor is out of order, the image forming apparatus determines whether or not the sensor determined to be out of order is a sensor that can be ignored to continue the printing processing according to the setting. In this way, in a case in which the sensor such as a sensor that may significantly reduce the print quality is out of order, the image forming apparatus can prevent the printing processing which ignores the sensor out of order from being continued.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a conveyance section configured to form a conveyance path for conveying paper;

a plurality of sensors configured to output detection signals indicating an existence of the paper at a plurality of positions along the conveyance path;

an image forming section configured to form an image on the paper conveyed by the conveyance section;

a conveyance control section configured to control the conveyance of the paper conveyed by the conveyance section based on the detection signals of the plurality of sensors; and a control section configured to determine, in a case in which a detection signal of a sensor from the plurality of sensors is abnormal, whether a cause of the abnormality is due to a failure of the sensor or a failure of paper conveyance, and continues processing and ignores the detection signal when the cause of the abnormality is due to the failure of the sensor;

a memory configured to store information indicating a usage status of the image forming apparatus, wherein the control section determines the cause of the abnormality is due to the failure of the sensor if a number of abnormality-occurrence times of the detection signal of the failed sensor is above a first value, and if the information indicating the usage status stored in the memory is above a second value.

2. The image forming apparatus according to claim 1, wherein the memory stores a total number of printings in the image forming apparatus; and the second value is a reference value for the total number of printings of the image forming apparatus.

3. An image forming apparatus, comprising:

a conveyance section configured to form a conveyance path for conveying paper;

a plurality of sensors configured to output detection signals indicating an existence of the paper at a plurality of positions along the conveyance path;

an image forming section configured to form an image on the paper conveyed by the conveyance section;

a conveyance control section configured to control the conveyance of the paper conveyed by the conveyance section based on the detection signals of the plurality of sensors; and a control section configured to determine, in a case in which a detection signal of a sensor of the plurality of sensors is abnormal, whether a cause of the abnormality is due to a failure of the sensor or a failure of paper conveyance, and continues processing and ignores the detection signal when the cause of the abnormality is due to the failure of the sensor;

a memory configured to store a value indicating a usage status for each sensor, wherein the control section determines the cause of the abnormality is due to the failure of the sensor if a number of abnormality-occurrence times of the detection signal of the failed sensor is above a first value, and if the value stored in the memory indicating the usage status for the failed sensor is above the second value.

4. The image forming apparatus according to claim 3, wherein, the memory stores a total number of printings during an operation period of each sensor; and the second value is a reference value for the total number of printings of each sensor stored in the memory.

5. An image forming apparatus according, comprising:

a conveyance section configured to form a conveyance path for conveying paper;

a plurality of sensors configured to output detection signals indicating an existence of the paper at a plurality of positions along the conveyance path;

an image forming section configured to form an image on the paper conveyed by the conveyance section;

a conveyance control section configured to control the conveyance of the paper conveyed by the conveyance section based on the detection signals of the plurality of sensors; and a control section configured to determine, in a case in which the detection signal of a sensor of the plurality of sensors is abnormal, whether a cause of the abnormality is due to a failure of the sensor or a failure of paper conveyance, and continues processing and ignores the detection signal when the cause of the abnormality is due to the failure of the sensor, wherein the control section determines whether or not it is possible to ignore the failure of the sensor and continue the conveyance of paper, and then ignores the failure of the sensor to instruct the paper conveyance if the paper conveyance is determined to be possible, or stops the paper conveyance if the paper conveyance is determined to be impossible.

6. The image forming apparatus according to claim 5, wherein the control section determines, in a case in which the abnormality is due to a failure of more than one sensor, whether or not it is possible to ignore the detection result of each failed sensor and continue the conveyance of paper based on a combination of failed sensors.

* * * * *